United States Patent [19]

Takasawa

[11] Patent Number: 4,704,503

[45] Date of Patent: Nov. 3, 1987

[54] SLIDE-ACTION SWITCH WITH MOVABLE CONTACT LIFTING MEANS

[75] Inventor: Kazuhiro Takasawa, Furukawa, Japan

[73] Assignee: Alps Electric Co., Ltd., Japan

[21] Appl. No.: 838,287

[22] Filed: Mar. 10, 1986

[30] Foreign Application Priority Data

Mar. 9, 1985 [JP] Japan ..... 60-33989[U]

[51] Int. Cl.[4] ..... H01H 9/30; H01H 13/02; H01H 15/02

[52] U.S. Cl. ..... 200/16 B; 200/16 D; 200/159 R

[58] Field of Search ..... 200/11 E, 11 EA, 11 G, 200/11 TW, 16 R, 16 B, 16 C, 16 D, 61.76–61.81, 159 R, 159 A, 239–242, 252, 253, 164 R, 164 A, 165

[56] References Cited

U.S. PATENT DOCUMENTS

| | | | |
|---|---|---|---|
| 2,993,968 | 7/1961 | Ellithorpe | 200/11 EA X |
| 3,142,742 | 7/1964 | Kaleba et al. | 200/159 R |
| 3,255,319 | 6/1966 | Paine | 200/11 EA |
| 3,261,955 | 7/1966 | Martin | 200/159 A |
| 3,300,594 | 1/1967 | Paine et al. | 200/11 G |
| 3,842,229 | 10/1974 | Boulanger | 200/159 R |
| 3,944,761 | 3/1976 | Nicholl et al. | 200/11 EA |
| 4,012,608 | 3/1977 | Lockard | 200/164 X |
| 4,316,065 | 2/1982 | Rupp et al. | 200/16 B X |
| 4,609,795 | 9/1986 | Lavigne et al. | 200/159 A X |

*Primary Examiner*—J. R. Scott

*Attorney, Agent, or Firm*—Guy W. Shoup

[57] ABSTRACT

A slide-action switch in which a fixed contact is provided on an insulating wafer has a projection for raising and holding a movable contact away from the surface of the wafer when the movable contact slides to its open circuit position so as to eliminate a high voltage arcing path formed by metal powder left on the surface of the wafer. The metal powder is created by the sliding action of the movable contact against the fixed contact.

2 Claims, 6 Drawing Figures

SLIDE-ACTION SWITCH WITH MOVABLE CONTACT LIFTING MEANS

BACKGROUND OF THE INVENTION

1. Field of the Invention

This invention relates to a slide-action switch used for example in connection with a door of a refrigerator and, more broadly, to an improvement on a switch of the type wherein a movable contact slidingly engages and disengages with a fixed contact.

2. Description of the Prior Art

FIGS. 2 and 3 show a conventional switch of the above type. In these drawings, reference numeral 1 indicates a switch body which is provided with a control knob 2 urged outwardly by a spring (not shown). This control knob 2 has a slide 6 movable together therewith, which supports a movable terminal 3. The end of this movable terminal 3 is bent arcwise to form a movable contact 3*a*.

Reference numeral 4 indicates an insulating wafer of the switch body 1, which has a fixed terminal 5 secured thereon. The movable contact 3*a* presses resiliently against the surface of the wafer 4. As the control knob 2 is pushed into the switch body, the movable contact 3*a* slides on the wafer 4 and comes into contact with a fixed contact region of the fixed terminal 5 thereby forming an electrical connection between the fixed terminal 5 and the movable terminal 3.

As the movable contact 3*a* slides against the contact region of the fixed terminal 5, it wipes away dirt and thus assures a good electrical connection. However in the foreging conventional switch, metal on the surface of each terminal is rubbed off and it forms a contaminating powder which remains on the surface of the insulating wafer 4 and contaminates a region 4*a* of the wafer which is supposed to act as an insulating barrier between the fixed terminal 5 and the movable contact 3*a* when the latter is slid away from the former. Due to this contamination, the conventional prior art switch loses its ability to resist high voltage. In its open-circuit state, the switch cannot prevent a high voltage arc from crossing the powder contaminated region on the wafer surface; so the lifetime of the switch and the appliance in which it is installed becomes prematurely shortened by powder generated from its sliding metal contacts.

SUMMARY OF THE INVENTION

It is an object of the present invention to provide a slide-action switch which has solved the foregoing drawback of the prior art, is not degraded by contaminating powder, withstands high voltage and has a long lifetime.

To achieve the foregoing object, the present invention provides a slide-action switch having means for rasing a movable contact away from a wafer surface which might be contamined by metal powder when the movable contact is slid towards its open-circuit position. For example, a projection is provided on the wafer at a reset position of a movable terminal, such that the projection engages a portion of the movable terminal when the latter slides to its reset (open-circuit) position and a contact portion of the movable terminal is forced away from the wafer surface by this projection.

DESCRIPTION OF THE PREFERRED EMBODIMENT

An embodiment of the present invention will now be described with reference to the drawings.

Figure 1A:
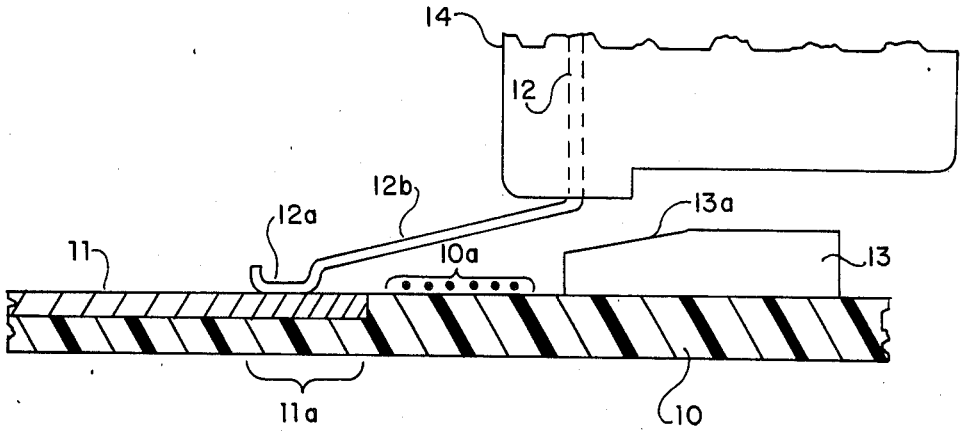
FIGS. 1(*a*) and 1(*b*) are sectional views of the important portion of a switch according to the present invention.
Figure 1B:
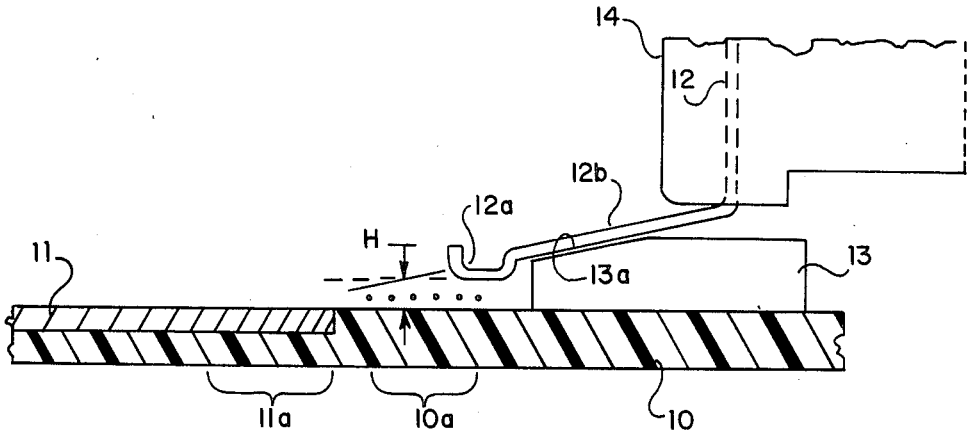

In FIGS. 1(*a*) and 1(*b*), reference numeral 10 indicates a wafer on which a fixed terminal 11 is secured. Reference numeral 12 indicates a movable terminal supported by a slide 14. A first portion of the movable terminal is bent in an arc to form a movable contact 12*a* which slidingly engages and disengages with a contact region 11*a* of the fixed terminal 11. Reference numeral 13 indicates a projection formed on the wafer 10 at a position corresponding to the open-circuit position of the movable terminal 12. The projection 13 has a tapered end face 13*a*.

Describing the operation of the switch of the foregoing configuration, as a control knob is pushed into the switch body, the movable terminal 12 held by the slide 14, moves and the movable contact 12*a* of the movable terminal 12 comes into sliding contact with the fixed terminal 11 as shown in FIG. 1(*a*). On the other hand, when the control knob is released, due to the action of reset spring 15 (shown in FIG. 4) the movable terminal 12 returns to its open-circuit position, and as it returns, a second portion 12*b* of the movable terminal 12 engages the projection 13 to raise and hold the movable contact 12*a* of the movable terminal 12 a predetermined height, H, above the powder contaminated region 10*a* of the wafer 10. That is, when the switch is in the open-circuit state, the movable contact 12*a* of the movable terminal 12 is held spaced a certain distance from the surface of the wafer 10.

Figure 2:
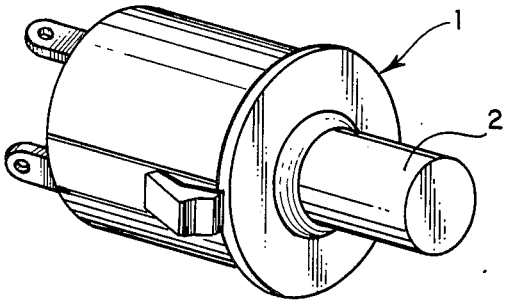
FIG. 2 PRIOR ART
FIG. 2 is a perspective view of a prior art switch body.
Figure 3:
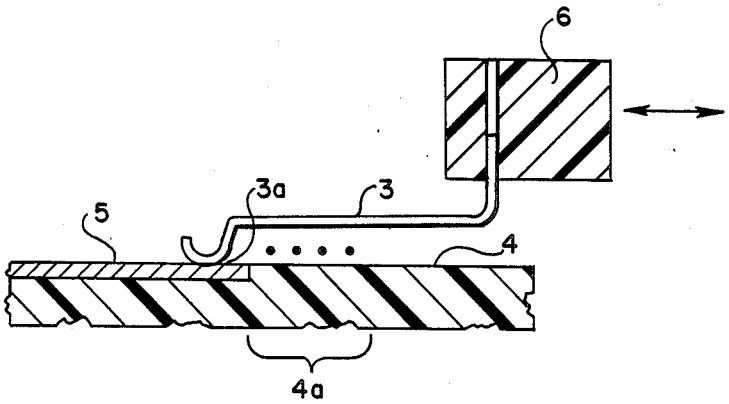
FIG. 3 PRIOR ART
FIG. 3 is a sectional view of the important portion of a conventional switch.
Figure 4:
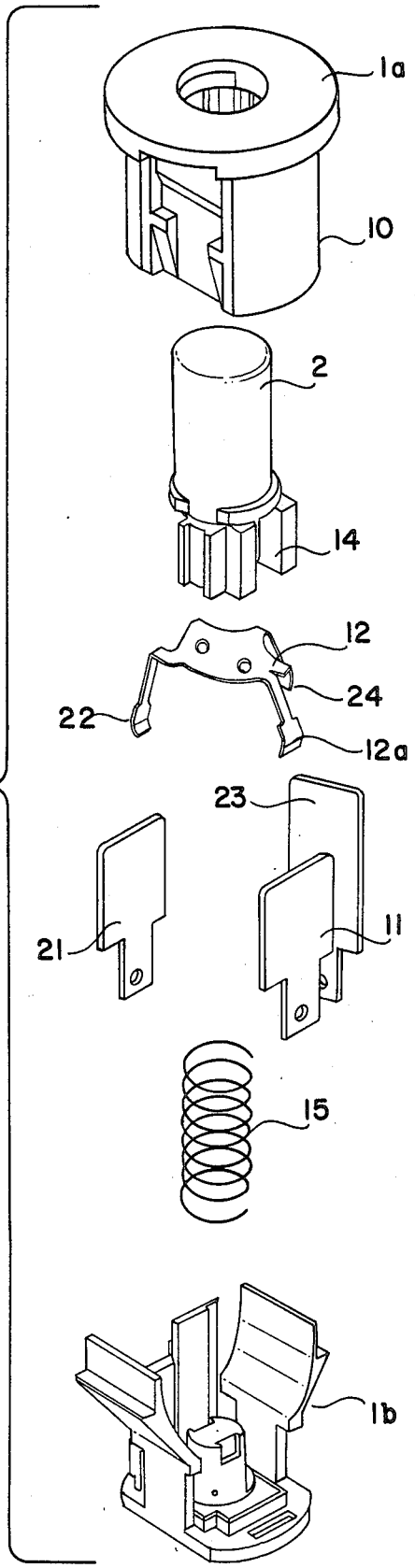
FIG. 4 is an exploded view of one embodiment of the present invention.
Figure 5:
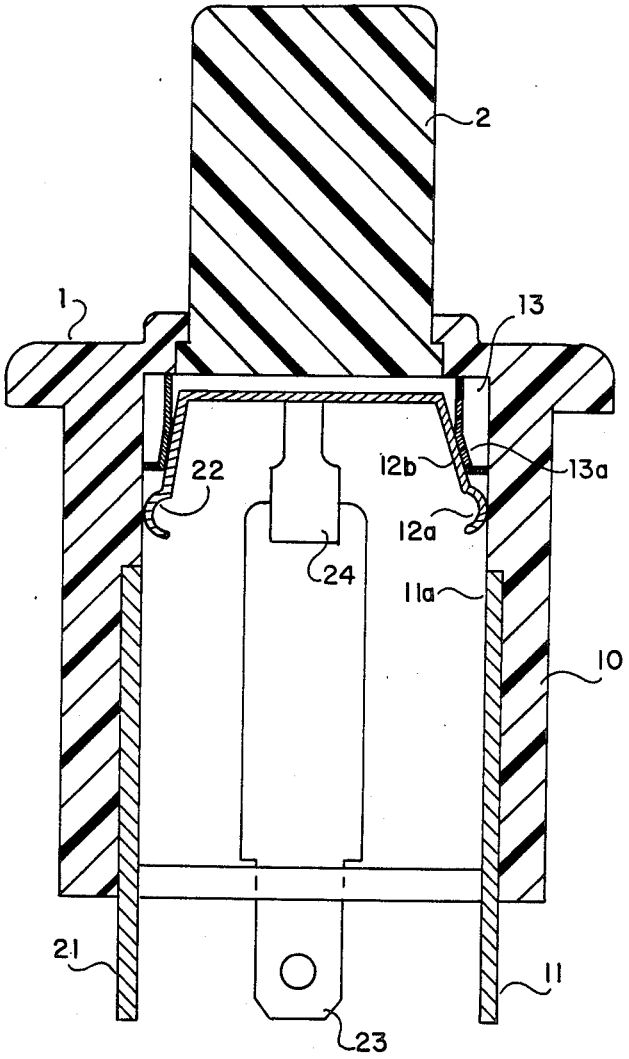
FIG. 5 is a section view of the embodiment of FIG. 4.

FIGS. 4 and 5 show one embodiment of the present invention as applied to a switch having the body shown in FIG. 2. Like portions are numbered with the same reference numbers used in FIGS. 1–3 and their description is therefore omitted. The switch body is formed of upper and lower case members 1*a* and 1*b*. A return spring 15 is provided between the lower case member 1*b* and the slide 14 for urging the slide toward its normal position. A movable terminal 12 made of spring metal is provided with arc-shaped contacts 12*a*, 22 and 24. Three fixed terminals, 11, 21 and 23 are staked through the lower case member 1*b* and provide fixed contact regions corresponding to the three movable contacts of the movable terminal 12. When the knob 2 is fully depressed, an electrical connection is made between fixed terminals 11 and 21. Fixed terminal 23 serves as a common connection.

Of importance, a projection 13, made of an insulating material, is provided integrally on the inside wall of the upper case member 1*a* which forms the wafer 10 as described earlier. The projection 13 has a tapered end 13*a* which engages portion 12*b* of the movable terminal 12 so that the switch portion composed of fixed terminal 11 and movable contact 12*a* will exhibit good resistance to high voltage when the movable contact 12*a* separates from the wafer surface.

As is apparent from the foregoing description, according to the present invention, the movable contact of the movable terminal is separated from the powder contaminated portion of the insulating wafer when the switch is in the open-circuit state, so that shorting arcs cannot pass through via the powder contaminated region, so the switch exhibits good voltage-withstandability (insulation property, and possesses a long lifetime.

While the preferred embodiment has a tapered end face 13*a* on the projection 13 which is engaged by the second portion 12*b* of the movable terminal 12, it is also within the scope of the present invention to provide the second portion 12*b* formed at an inclined angle to engage with a rounded edge of a projection 13 or vice versa to provide only the end face 13*a* at an inclined angle to be engaged by a curved portion of the movable terminal 12 other than the contamined contact 12*a*.

I claim:

1. A slide-action switch comprising:

an insulating wafer having an opening in one end, a body portion provided with an inner wall defining a slide surface toward said one end, and a closed end opposite said one end;

an actuating member disposed in said opening of said one end which is reciprocally movable in an axial direction of said insulating wafer parallel to said slide surface;

a fixed contact disposed on said inner wall of said wafer body portion spaced remote from said one end toward said closed end of said wafer and having an exposed conductive surface which is substantially flush with the slide surface of said inner wall between said fixed contact and said one end;

a movable terminal mounted to said actuating member so as to be reciprocally movable in said axial direction in said body portion of said insulating wafer over a predetermined distance and having an elongated, resilient movable contact provided with an inclined portion extending at an inclined angle toward the slide surface of the insulating wafer and a conductive end portion slidable thereon into conductive contact with said exposed conductive surface of said fixed contact at a contact position remote from said one end; and lifting means including an engaging projection formed on said inner wall of said insulating wafer toward said one end which is engageable with said inclined portion of said movable contact when said terminal is moved to a non-contact position toward said one end for resiliently lifting the end portion of said movable contact completely away from the slide surface of said inner wall at the non-contact position, whereby short circuiting between said movable contact and any contaminating particles on said inner wall of said insulating wafer is prevented at the non-contact position.

2. A slide-action switch according to claim 1 wherein said projection is integral with said wafer.

* * * * *